United States Patent [19]

Kelso

[11] 3,984,213

[45] Oct. 5, 1976

[54] SLOW GRINDING TECHNIQUE

[75] Inventor: Walter T. Kelso, East Hartford, Conn.

[73] Assignee: United Technologies Corporation, Hartford, Conn.

[22] Filed: Nov. 6, 1974

[21] Appl. No.: 521,605

[52] U.S. Cl. ..... 51/281 R

[51] Int. Cl.[2] ..... B24B 1/00

[58] Field of Search ..... 51/281 R, 322, 267, 51/74 R, 77 R, 78, 80 A, 82 R, 92 R

[56] References Cited

UNITED STATES PATENTS

| | | | |
|---|---|---|---|
| 2,378,903 | 6/1945 | Baldenhofer | 51/92 R |
| 2,899,781 | 8/1959 | Williams | 51/267 |
| 3,157,969 | 11/1964 | Fant | 51/92 R X |

OTHER PUBLICATIONS

*American Machinist's Handbook*, McGraw-Hill, N.Y., 1955, pp. 5-5 thru 5-7.

*Primary Examiner*—Gary L. Smith

*Attorney, Agent, or Firm*—Charles A. Warren

[57] ABSTRACT

A method of abrasive removal of material from a workpiece by deep cuts at a very slow relative movement of the abrasive material over the workpiece, with little or no heating of the workpiece and little wheel wear.

8 Claims, 3 Drawing Figures

SLOW GRINDING TECHNIQUE

SUMMARY OF THE INVENTION

This invention relates to rapid removal of material from a workpiece by an abrasive wheel having a slow surface speed and a slow feed rate over the surface of the workpiece contacted by the wheel. Up to the present time it has been customary to have a high surface speed for the wheel and to remove a small quantity of material for each passage of the wheel over the work. At the same time the griinding area is flooded with coolant to prevent overheating of the material of the workpiece adjacent to the grinding area. This procedure has not been satisfactory. Possibly because the high speed of the wheel tended to throw the coolant away from the grinding area or for other reasons the workpiece frequently overheated, the wheel has worn down rapidly and material removal was slow especially with workpieces made of hard-to-work materials. This is especially true of many of the high temperature materials, as for example nickel or cobalt base alloys used in high temperature areas of gas turbine engines, in hard-facing materials and in other hard-to-machine materials.

The present invention overcomes these objections by a rapid removal of material from the workpiece which is accomplished by deep cuts in the workpiece with a slow surface speed for the wheel and with coolant supplied tothe grinding area. The relative movement between the wheel surface and the workpiece surface engaged thereby is relatively slow and it is found that heating of the workpiece is minimized and there is also a minimum of wheel wear. The result is a rapid removal of workpiece material without the usual detrimental results.

According to the invention the wheel is rotated at such a speed as to produce a surface speed of about 1600 to 2000 surface feet per minute and is fed into the workpiece at a feed rate of between ½ to 2 inches per minute. The contact area between the wheel and work is flooded by coolant at high velocity to assure an adequate supply of coolant in the contact area. For example, quantities of coolant as much as 50 or more gallons per minute at 40 to 100 pounds per square inch pressure or possibly more may be supplied through a nozzle contoured to supply the coolant to the entire wheel contact area.

The foregoing and other objects, features, and advantages of the present invention will become more apparent in the light of the following detailed description of preferred embodiments thereof as illustrated in the accompanying drawing.

DESCRIPTION OF THE PREFERRED EMBODIMENT

Figures 1, 2, 3:
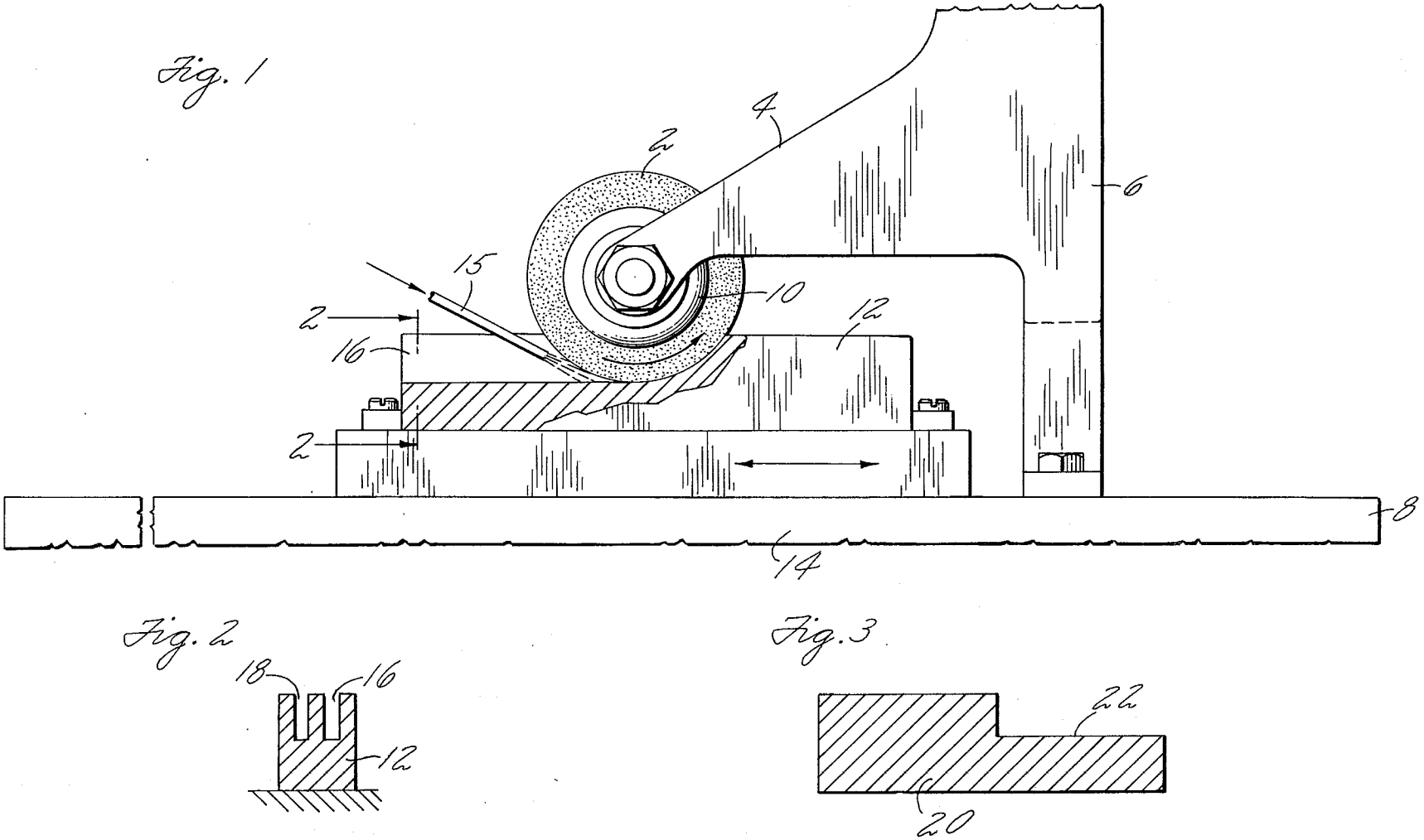
FIG. 1 is a diagrammatic view of a grinding operation incorporating the invention.
FIG. 2 is a sectional view through a workpiece showing a grinding operation performed by this invention.
FIG. 3 is a view similar to FIG. 2 showing another workpiece.

Referring first to FIG. 1, the grinding wheel 2 is supported on a carrying arm 4 extending from a frame 6 mounted on a base 8. The wheel is driven by a motor 10 which may be on the same shaft as the wheel. The workpiece 12 is mounted on a table 14 suitably movable on the base 8. The frame 6 may straddle the table to provide the necessary movement of the workpiece against the wheel. Suitable feed mechanism, not shown, moves the table so as to feed the workpiece against the wheel. The motor is so controlled as to cause the surface speed of the wheel to be about 1800 surface feet per minute. Surface speeds between 1600 and 2000 are acceptable but the preferred speed is dictated by the material being ground according to its metallurgical and grinding characteristics. Coolant is delivered through a nozzle 15.

The workpiece 12 shown in FIG. 1 is shown in section in FIG. 2. The wheel of FIG. 1 is contoured with two ribs on its periphery to form the two slots 16 and 18 simultaneously. In the particular arrangement shown the groove 16 is 0.093 inch wide and goove 18 is 0.125 inch wide. The grooves are 0.550 inch deep. The material is AMS 5754 and is considered very difficult to grind. It has a machinability factor of 18. The grooves formed were 6 inches long. With the surface speed of the wheel at 1800 surface feet per minute, and a wheel feed of 1.62 inches per minute the grooves were cut to the full depth desired in one pass of the wheel and the desired groove contour, including the sharp bottom corners, was maintained for the entire length with no significant wheel wear.

The wheel was a standard aluminum oxide wheel and the coolant used was a heavy-duty sulpho-chlorinated soluble oil delivered into the groove through a nozzle at 60 pounds per square inch and a quantity of 50 gallons per minute. After machining approximately 24 linear inches in successive workpieces no wheel loading was evident and there was no measurably side wheel wear. The actual outer diameter wheel wear was 0.0015 inch per inch of groove. In these 24 inches of grinding a corner radius of 0.020 inch was maintained at the base of the slots without dressing the wheel.

Another workpiece 20 as in FIG. 3 was slow ground to form the notch 22 in one wheel pass. The material is Waspalloy (AMS 5706). The dimension of the cut was ⅝ inch deep and 2⅝ inches wide. The length of the cut was 1 9/16 inches. The wheel speed was 1800 surface feet per minute and the wheel feed rate was 0.687 inch per minute. There was negligible wheel loading and the wheel wear was 0.002 inch per inch of feed. A corner radius was maintained at 0.020 for the full length of two cuts.

The wheel used was a commercially available aluminum oxide vitrified wheel 14 inches in diameter. The coolant used was heavy-duty sulpho-chlorinated soluble oil and was supplied to the cut in a quantity of 50+ gallons per minute.

It has been found that Inconel 718 (AMS 5663) is readily ground by this "slow grind" process. For example, a bar of this material 1 7/16 inches wide was surface ground to a depth of 0.500 inch. The wheel speed was 1950 surface feet per minute and the rate of work feed into the wheel was 1.625 inches per minute. Wheel wear was 0.001 inch per inch of feed and there was no detrimental wheel loading.

Other materials such as titanium may also be slow ground without surface damage to the workpiece. For example, one titanium alloy, AMS 4928, was ground by a single pass to a depth of 0.100 inch, forming a slot with bottom radii limits of 0.010 to 0.020 for an inch long slot. Wheel loading was virtually non-existant and wheel wear was 0.001 inch per inch of cut.

One problem is in grinding hard-facing which is applied to keyways or grooves or surfaces subjected to severe wear. This hard facing may be a cobalt base alloy (PWA 691) or other similar wear resistant alloy. Such hard facing is readily "slow ground". For example a hard-faced slot, the hard facing being an alloy identified as PWA 691 similar to Haynes Stellite 3, was slow ground with a wheel surface speed of 1850 surface feet per minute and a feed rate of 0.750 inch per minute. The slots were finished to the required width of 0.3859 ± 0.0007 inch and to a depth of 0.350 inch in a single pass of the wheel. The finished workpiece was inspected and the surfaces of the slot were found to be free of heat checks and/or cracks and the workpiece was acceptable for use. The grinding wheel used was an aluminum oxide vitrified wheel although such a wheel is not necessary to the success of the slow grind process.

This process is usable for materials presently ground in the conventional manner, but is also usable for materials, as above indicated, that are normally considered difficult to grind by reason of wheel loading, or thermal damage to the workpiece. For example, titanium is subject to surface damage and thermal cracking. Hard facing alloys are normally subject to severe thermal cracking. Materials with low machinability by conventional cutting techniques can be slow ground with good cutting rates.

It is important that a significant quantity of coolant be supplied to the contact area between the wheel surface or surfaces and the workpiece and to be most effective it is supplied at a point where the wheel surface is tangent to the workpiece surface. The type of coolant is not critical but it is essential that adequate coolant be supplied to cool both wheel and work and effectively to flood all the operative surfaces of the wheel. This type of grinding has, however, been found to produce less heating of the workpiece than conventional grinding procedures.

This form of grinding is most effective where a significant amount of material is removed in a single pass of the grinding wheel. The depth of cut appears not to be limited and, as above indicated depths of cut of more than ⅝ inch are readily performed. Since the grinding is done in a single pass the wheel is not subjected to the action of the edge of the workpiece which in contacting the wheel performs an undesired dressing operation. In conventional grinding this "edge" dressing occurs on each pass of the wheel; in the present technique, the wheel is submerged in the work as soon as the centerline of the wheel passes the leading edge of the workpiece.

Although the invention has been shown and described with respect to a preferred embodiment thereof, it should be understood by those skilled in the art that other various changes and omissions in the form and detail thereof may be made therein without departing from the spirit and the scope of the invention.

I claim:

1. In the process of removal of material from a workpiece having a low machinability factor by a single pass grinding operation with a minimum amount of wheel wear, the steps of rotating a grinding wheel to produce a surface speed of from 1600 to 2000 surface feet per minute, feeding the grinding wheel relative to the work at a speed of from ¼ to 2 inches per minute, positioning the wheel relative to the workpiece for removal of a depth of material greater than 0.100 inch in a single pass of the workpiece relative to the wheel, and supplying coolant to the contact area between the wheel and workpiece.

2. The process of claim 1 in which the removal of material produces a slot in the workpiece with opposed finished surfaces.

3. The process of removing material by grinding from a workpiece of a material having a low machinability factor by grinding with a minimum amount of grinding wheel wear, including the steps of rotating the grinding wheel to provide a surface speed of about 1600 to 2000 surface feet per minute, feeding the workpiece against the grinding wheel at a feed rate of between about ¼ and 1 inch per minute, and positioning the wheel relative to the workpiece for removal of a depth of material from 0.100 inch to 0.600 inch in a single pass of the workpiece relative to the wheel.

4. The process of claim 3 including the step of supplying coolant to the contacting surfaces of the wheel and workpiece to prevent undesired heating of either wheel or workpiece surfaces.

5. The process of claim 3 in which the material is a material subject to surface damage by conventional cracking, and in which the depth of cut is between 0.100 and 0.350 inches in a single pass of the wheel.

6. The process of claim 3 in which the material is AMS5706 or the like, and wherein the depth of cut is more than ½ inch, the wheel speed is about 1800 surface feet per minute and the feed is about 158 inch per minute.

7. The process of claim 3 in which the material is titanium, the depth of cut is about 0.100 inch and the wheel speed is about 1800 surface feet per minute.

8. The process of removing material by grinding from a workpiece of a material having a low machinability factor to form a notch in the workpiece having two surfaces at right angles and a corner radius therebetween without significant wear on the wheel during the operation, including rotating the grinding wheel to provide a surface speed of from 1600 to 2000 surface feet per minute, feeding the workpiece against the grinding wheel at a feed rate of between ¼ and 1 inch per minute, positioning the wheel relative to the workpiece to remove a depth of material from 0.100 to 0.600 inches in a single pass of the wheel relative to the work, and maintaining the desired notch contour without redressing the wheel during the operation.

* * * * *

UNITED STATES PATENT OFFICE

CERTIFICATE OF CORRECTION

PATENT NO. : 3,984,213

DATED : Oct. 5, 1976

INVENTOR(S) : Walter T. Kelso

It is certified that error appears in the above-identified patent and that said Letters Patent are hereby corrected as shown below:

Column 1, line 12: "griinding" should read --grinding-- line 30: "tothe" should read --to the-- line 40: "1/2" should read --1/4--

Column 2, line 17: "goove" should read --groove--

Claim 6, column 4, line 41: "158" should read --5/8--

Signed and Sealed this

Fourteenth Day of December 1976

[SEAL]

*Attest:*

RUTH C. MASON
*Attesting Officer*

C. MARSHALL DANN
*Commissioner of Patents and Trademarks*